United States Patent [19]

Grobler

[11] 4,047,497

[45] Sept. 13, 1977

[54] APPARATUS FOR IMPREGNATING CONSTRUCTIONAL ELEMENTS

[76] Inventor: Johannes Hermanus Grobler, 112 Valley View Road, Crest View, South Africa

[21] Appl. No.: 652,282

[22] Filed: Jan. 26, 1976

[51] Int. Cl.[2] ..... B05C 7/00

[52] U.S. Cl. ..... 118/50; 118/408; 52/515; 141/287; 141/312; 425/13

[58] Field of Search ..... 118/50, 408, 3, 317; 52/515, 517; 222/519, 522; 141/287, 312; 425/13; 285/196

[56] References Cited

U.S. PATENT DOCUMENTS

| | | | |
|---|---|---|---|
| 1,926,415 | 9/1933 | Wertz | 425/13 |
| 1,988,450 | 1/1935 | Kelley | 52/515 X |
| 2,263,070 | 11/1941 | Cusick | 52/515 X |
| 2,955,796 | 10/1960 | Titchenal | 141/287 X |
| 3,285,299 | 11/1966 | Henry et al. | 141/312 |
| 3,352,333 | 11/1967 | Glasgow et al. | 141/312 X |
| 3,676,198 | 7/1972 | McGroarty | 52/515 X |
| 3,896,763 | 7/1975 | Lau et al. | 118/50 |

*Primary Examiner*—James Kee Chi

*Attorney, Agent, or Firm*—Cushman, Darby & Cushman

[57] ABSTRACT

Apparatus is disclosed for impregnating a wall or the like with damp-proofing fluid. The apparatus comprises a conduit through which the fluid passes and carrying a sealing element designed to seal against the wall automatically under the pressure of the damp-proof fluid. Generally the sealing element comprises a grommet which is deformed into sealing contact with the wall, the deformation being effected either by the direct action of the damp-proofing fluid on the grommet or through an intermediate member such as a piston in a cylinder carried on the conduit.

1 Claim, 6 Drawing Figures

APPARATUS FOR IMPREGNATING CONSTRUCTIONAL ELEMENTS

This invention relates to the impregnation of buildings and other constructional elements with fluid such as damp-proofing fluid.

In the construction of buildings it is necessary to provide some means for preventing moisture from the earth penetrating up the walls by capillary action. It has been found necessary to devise some means for providing a "damp-proof course" (as it is called) after the wall has been constructed. One method was devised comprising the step of injecting a waterproof liquid into the wall along the bottom thereof. This method comprised drilling a hole in the wall and inserting in the hole a pipe sealed by a bung or grommet mounted over the pipe. Liquid was then pumped into the hole at about 100 p.s.i.

It is an object of the invention to provide apparatus which is much quicker to operate.

According to the invention there is provided, for impregnating a constructional element with a fluid under pressure, apparatus including a conduit for conveying the fluid and having an outlet through which the fluid is arranged to pass out of the conduit, and sealing means including a sealing element arranged to be mounted on the conduit and, under the pressure of the fluid, to deform into contact with the constructional element and constitute therewith a sealed space enclosing the outlet for containing the fluid.

In one form of the invention, for a constructional element in which is formed a recess comprised of at least one side wall, the sealing element is arranged to be inserted in the recess and expanded into contact with the side wall of the recess.

According to one aspect of the invention, the sealing means includes a tapered element arranged to be inserted in the recess with the sealing element slidably mounted on the tapered element, means being provided for moving the sealing element along the tapered element to thereby expand the sealing element into contact with the wall of the recess.

In one form of the invention, the fluid is arranged to come into direct contact with the sealing element.

In one alternative form of the invention, the sealing means includes mechanical means interposed between the sealing element and the fluid and arranged to move under the pressure of the fluid to deform the sealing element.

The mechanical means, according to one aspect of the latter form of the invention, comprises a piston mounted in a cylinder, a duct being provided for ducting the fluid to the cylinder for operating the piston.

According to yet another aspect of the invention, the conduit includes a first duct for conveying fluid to the mechanical means, and a second duct in communication with the first duct, arranged to convey fluid through the outlet in the conduit to the constructional element, control valve means being located in the second duct between the first duct and the outlet, the control valve means being arranged to close the second duct until the fluid attains a predetermined pressure higher than that required for the sealing means to be deformed.

Advantageously, the conduit includes a first duct for conveying fluid to the mechanical means, and a second duct arranged to convey fluid through the outlet in the conduit to the constructional element, first valve means being provided for controlling access of fluid to the first duct, and independently operable second valve means being provided for controlling access of fluid to the second duct.

The invention is discussed with further reference to the accompanying drawings, in which FIG. 1 is a cross-sectional elevation of known apparatus by means of which liquid was led into a hole.

Figure 1:
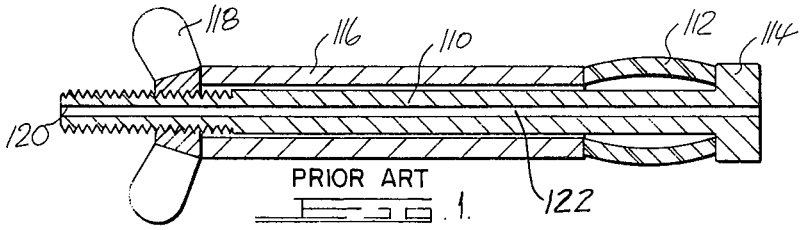
PRIOR ART FIG. 1.

The apparatus shown in FIG. 1 comprises a pipe 110 screw threaded at both ends. A grommet 112 is mounted over the pipe 110, in abutment at one end with a collar 114 and at the other end with a sleeve 116. The collar is fixed on the pipe but the sleeve is free to move thereon. A wing nut 118 is mounted on the pipe at the end opposite the collar. By turning the wing nut, the sleeve is forced towards the collar, thereby squeezing the grommet and causing it to bulge outwards into sealing contact with the walls of the hole in the wall. A pressure hose is joined to the end 120 by means of a suitable connection (not shown) and damp-proofing liquid is introduced into the hole through the bore 122 of the pipe 110.

As far as the applicant is aware, this apparatus has not been improved upon since it was introduced some years ago. It has a number of attendant disadvantages. First, it is relatively slow since it is manually operated. Second, it is liable to be ejected from the hole under pressure.

Figure 2:
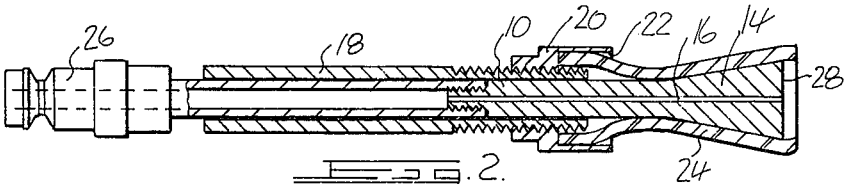
FIG. 2 is a cross sectional elevation of one apparatus for use in damp-proofing a constructional element.

In FIG. 2 the apparatus comprises a central pipe 10 on one end of which is an integral tapered piston element 14, having an axial bore 16. Over the pipe is mounted a sleeve 18 carrying a cup 20 having a recess 22 in which one end of a sealing grommet 24 is located. The other end of the pipe 10 carries a connection 26 on which is mounted a high pressure hose, not shown.

In use, the sleeve is pulled back until its free end abuts the connection 26; in this position the outer end 28 of the piston 14 projects beyond the free end of the grommet 24.

In this position, the grommet and piston are inserted in a hole formed in a constructional element such as a wall, the hole being of diameter a little greater than the maximum diameter of the piston. Once in the hole, the sleeve 18 is slid along the pipe 10 towards the piston. This causes the grommet to move towards the end 28 of the piston at the same time being radially expanded until it comes into contact with the wall of the hole. Liquid is now pumped through the connection 26 into the bore of the pipe and thence through the bore 16 of the piston into the hole in the wall. The hole is sealed against the liquid at low pressure by the grommet. As the pressure of the liquid builds up the piston tends to be forced backwards out of the hole. Friction prevents the grommet from moving in the hole and the piston thus expands the grommet even more, forcing it more tightly into contact with the wall of the hole and thereby improving the seal as the pressure builds up.

Figure 3:
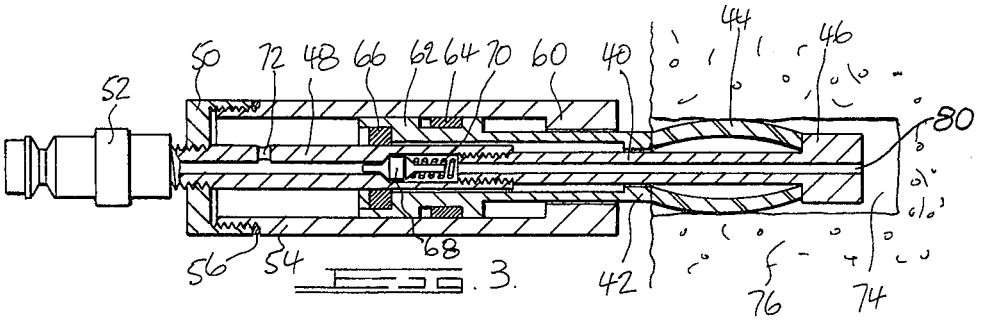
FIG. 3 is a cross sectional elevation of a second such apparatus.

In FIG. 3, the apparatus comprises a pipe 40, carrying a sleeve 42, a grommet 44 and a boss 46 at one end in similar fashion to the known apparatus shown in FIG. 1.

The boss 46 is shown as being formed integrally with the pipe 40 but it may be screwed thereon. The pipe is however joined to a second pipe 48 having at its free end a collar 50 and a connection 52 for receiving a pressure hose, not shown. One end of a hydraulic cylinder 54 is mounted on the collar 50 with a sealing gasket 56 therebetween. A guide bush 60 is formed in the other end of the hydraulic cylinder 54, the guide bush 60 having an axial bore in which the sleeve 42 is slidingly received. The sleeve 42 is integral with a piston 62 the outside of which is in sliding contact with the wall of the hydraulic cylinder 54, a hydraulic seal 64 being located therebetween. The piston has an axial bore through which slidingly passes the pipe 48, a second hydraulic seal 66 being located therebetween. The bore of the second pipe 48 has a frusto-conical seat on which a complementally shaped valve element 68 seats, being urged thereto by means of a compression spring 70 mounted between the valve element 68 and the end of the pipe 40.

A port 72 is formed in the wall of the pipe 48 adjacent the collar 50.

The apparatus operates in the following manner. A blind hole 74 is drilled in a wall 76 of a building and the end of the apparatus is inserted therein. The damp-proofing liquid is introduced into the pipe 48 through the connector 52. This fluid is at first stopped by the valve element 68 and enters the hydraulic cylinder through the port 72. The pressure thereof forces the piston towards the hole and thus the grommet is expanded into sealing contact with the wall of hole 74. The pressure of the fluid builds up until it is sufficient to overcome the force of the spring 70 holding the valve element 68 closed. When this happens fluid passes through the outlet 80 of the pipe 40 into the hole 74 of the wall. The hole is however already sealed by the grommet.

Clearly the strength of the spring can be selected to suit the needs of the apparatus. For fluid which ultimately attains a pressure of about 600 p.s.i., a spring which opens at about 120 p.s.i. has been found adequate.

It may be considered necessary to augment the sealing arrangement. To this end a second port 78 shown in FIG. 4 may be provided to allow fluid into the cavity between the pipe 40 and the grommet 44, the pressure of the fluid thus applying further expansion force to the grommet.

Figure 4:
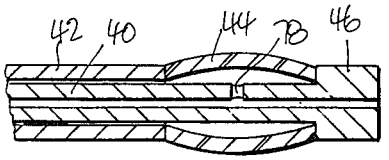
FIG. 4 is a fragmentary view of a modification of the apparatus of FIG. 3.

It is conceivable that the means shown in FIG. 4 of expanding the grommet may entirely supplant the piston arrangement shown in FIG. 3.

Figure 5:
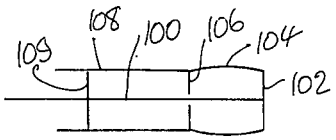
FIG. 5 is a schematic illustration of an alternative arrangement to the apparatus shown in FIG. 3.

In FIG. 5 there is shown schematically an alternative arrangement of apparatus shown in FIG. 3. Here the apparatus comprises a pipe assembly 100 with a collar 102 at its end and carrying a grommet 104. The piston 106 is however integral with the hydraulic cylinder 108. The other end of the cylinder 108 is sealed by an end element 109 fixed on the pipe assembly and in sliding contact with the face of the hydraulic cylinder. The piston/hydraulic cylinder assembly is thus in direct abutment with the grommet, the cylinder being arranged to move with the piston.

Figure 6:
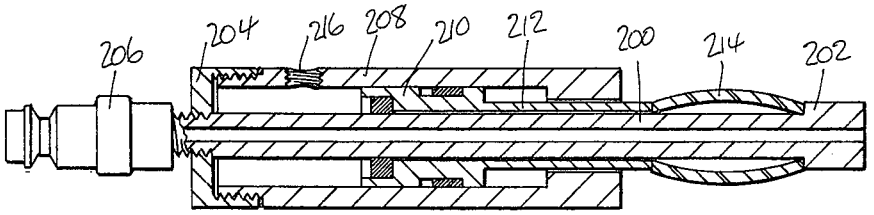
FIG. 6 is a cross sectional elevation of a third apparatus for use in damp-proofing a constructional element.

Yet another arrangement is shown in FIG. 6. Here the pipe 200 carries at one end a collar 202 and at the other end a collar 204 and a fitting 206 for connecting the pipe 200 to a high pressure hose, not shown. A hydraulic cylinder 208 is mounted on the collar 204. A piston 210 is slidingly received in the cylinder 208. The piston 210 is integral with a sleeve 212 which is slidably mounted on the pipe 200. A grommet 214 is located between the free end of the sleeve 212 and the collar 202 on the end of the pipe 200. A fitting for connecting the cylinder to a second high pressure hose, not shown, is mounted in the screw threaded hole 216 in the wall of the cylinder 208.

To operate the apparatus shown in FIG. 5, a manually operated valve in the second high pressure hose is opened, admitting damp-proofing fluid to the cylinder and causing the piston to move to the right hand end of the pipe 200 and thereby expanding the grommet 214. Thereafter a manually operated valve in the first mentioned high pressure hose is opened, admitting damp-proofing fluid to the pipe 200 and hence to the hole in which the apparatus is located.

One advantage of the improved apparatus (shown in any of the FIGS. 2 to 6) is that it is very much quicker to operate than the known apparatus. Second, the improved apparatus cannot be dislodged or leak under high pressure. In fact the seal improves as the pressure builds up. The improved apparatus has been operated at pressures well above that at which the known apparatus is capable of operating. This has led to even faster operation as the time taken for impregnation of walls by the fluid has been considerably reduced.

I claim:

1. Apparatus for impregnating a constructional element with a fluid under pressure, the apparatus being of the type comprising a conduit for conveying the fluid into a hole in the constructional element, a resiliently deformable sealing element, and a piston-and-cylinder assembly arranged to be actuated by the fluid to deform the sealing element to seal the conduit in the hole, a valve arranged to close to prevent the fluid from flowing through the conduit, means for supplying the piston-and-cylinder assembly with fluid from a point upstream of the valve, and means arranged automatically to close the valve until the pressure of the fluid reaches a higher level than that required to actuate the piston-and-cylinder assembly.

* * * * *